US007202606B2

(12) United States Patent
Eom et al.

(10) Patent No.: US 7,202,606 B2
(45) Date of Patent: Apr. 10, 2007

(54) LIGHT-EMITTING DISPLAY

(75) Inventors: Ki-Myeong Eom, Suwon-si (KR); Won-Kyu Kwak, Suwon-si (KR); Choon-Yul Oh, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 83 days.

(21) Appl. No.: 11/110,860

(22) Filed: Apr. 21, 2005

(65) Prior Publication Data

US 2005/0243037 A1 Nov. 3, 2005

(30) Foreign Application Priority Data

Apr. 29, 2004 (KR) ..... 10-2004-0030228
Aug. 20, 2004 (KR) ..... 10-2004-0065784

(51) Int. Cl.
*G09G 3/10* (2006.01)
*G09G 3/30* (2006.01)
*G09G 5/00* (2006.01)

(52) U.S. Cl. ..... 315/169.3; 345/76; 345/92; 345/204

(58) Field of Classification Search ..... 315/169.1, 315/169.3, 169.4; 345/44–46, 48, 52, 55, 345/90, 76, 211, 204
See application file for complete search history.

(56) References Cited

U.S. PATENT DOCUMENTS 6,501,448 B1 12/2002 Komiya et al. ..... 345/80
6,975,293 B2 * 12/2005 Yen et al. ..... 345/82
2003/0189535 A1 10/2003 Matsumoto et al. ..... 345/76
2004/0145547 A1 * 7/2004 Oh ..... 345/76
2005/0179624 A1 * 8/2005 Sun ..... 345/76
2005/0212446 A1 * 9/2005 Eom ..... 315/169.3

FOREIGN PATENT DOCUMENTS

EP 1 130 565 9/2001

* cited by examiner

*Primary Examiner*—Trinh Vo Dinh
(74) *Attorney, Agent, or Firm*—H.C. Park & Associates, PLC

(57) ABSTRACT

A pixel circuit of a light-emitting display that reduces the influence of kickback generated by parasitic capacitance. The pixel circuit includes first to fourth transistors, a capacitor, and a light-emitting element. The first and second transistors are serially coupled to each other and turned on in response to a first control signal. The capacitor is coupled in parallel with the first and second transistors. The third transistor supplies a data voltage to a first electrode of the capacitor in response to a select signal. The fourth transistor outputs a current corresponding to its gate-source voltage, which is based on the voltage of the capacitor. The light-emitting element emits light corresponding to the current from the fourth transistor.

11 Claims, 7 Drawing Sheets

LIGHT-EMITTING DISPLAY

CROSS REFERENCE TO RELATED APPLICATION

This application claims priority to and the benefit of Korean Patent Application No. 10-2004-0030228, filed on Apr. 29, 2004, and Korean Patent Application No. 10-2004-0065784, filed on Aug. 20, 2004, which are hereby incorporated by reference for all purposes as if fully set forth herein.

BACKGROUND OF THE INVENTION

1. Field of the Invention

The present invention relates to a light-emitting display, and more specifically, to an organic light-emitting display using luminescence of an organic material.

2. Discussion of the Background

Generally, an organic light-emitting display emits light with an organic light-emitting element that uses luminescence of an organic material. N×M organic light-emitting cells, arranged in a matrix form, may be driven with a voltage or current to display images. The organic light-emitting cell may also be called an organic LED (light-emitting diode) because it has diode characteristics, and it may include an anode (ITO), an organic thin film, and a cathode (metal). The organic thin film may have a multi-layer structure including an emitting layer (EML), an electron transport layer (ETL), and a hole transport layer (HTL) for balancing electrons and holes to improve luminescence efficiency. The organic thin film may further include an electron injecting layer (EIL) and a hole injecting layer (HIL).

Organic light-emitting cells may be driven by a passive matrix driving method or an active matrix driving method, which may use a thin film transistor (TFT) or a MOSFET. The passive matrix organic EL display may be constructed having an anode and a cathode that are perpendicular to each other, and a line may be selected to drive the light-emitting cells. The active matrix display may comprise a TFT coupled to each ITO pixel electrode, and it may be driven by a voltage maintained by a capacitor coupled to the gate of the TFT.

A conventional active matrix organic light-emitting display will now be explained.

FIG. 1 is an equivalent circuit diagram showing a pixel of a conventional active matrix organic light-emitting display. Referring to FIG. 1, the pixel circuit may include an organic LED OLED, a switching transistor SM, a driving transistor DM, and a capacitor Cst. The two transistors SM and DM may be PMOS transistors.

When the switching transistor SM turns on in response to a select signal applied to its gate from a signal line Sn, a data voltage $V_{DATA}$ from a data line Dm is supplied to the gate of the driving transistor DM. Then, a current $I_{OLED}$, corresponding to a voltage $V_{GS}$ charged between the gate and source of the driving transistor DM according to the capacitor Cst, may flow through the driving transistor DM, thereby causing the organic LED OLED to emit light. Here, the current $I_{OLED}$ may be represented by Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

In the pixel circuit of FIG. 1, a current corresponding to the data voltage may be supplied to the organic LED, thereby causing it to emit light with at a luminance corresponding to the current. The data voltage may have multiple values in a specific range in order to represent a predetermined gray scale.

As Equation 1 shows, however, the current $I_{OLED}$ varies with the threshold voltage $V_{TH}$ of the driving transistor DM. Accordingly, the organic light-emitting display may not display correct images because the driving transistors of the pixels may have different threshold voltages.

SUMMARY OF THE INVENTION

The present invention provides a light-emitting display having a pixel circuit that may compensate for the threshold voltage of a driving transistor.

The present invention provides a light-emitting display that may reduce the influence of kickback caused by parasitic capacitance existing in the pixel circuit.

Additional features of the invention will be set forth in the description which follows, and in part will be apparent from the description, or may be learned by practice of the invention.

The present invention discloses a light-emitting display comprising a plurality of data lines transmitting a data voltage, a plurality of scan lines transmitting a select signal, and a plurality of pixel circuits coupled to the scan lines and the data lines. A pixel circuit includes first, second, third, and fourth transistors, a first capacitor, and a light-emitting element. The first and second transistors are serially coupled to each other and turned on in response to a first control signal. The first capacitor is coupled in parallel with the first and second transistors. The third transistor supplies the data voltage to a first electrode of the first capacitor in response to the select signal. The fourth transistor outputs a current corresponding to its gate-source voltage, which is based on a voltage of the first capacitor. The light-emitting element emits light in response to the current from the fourth transistor.

The present invention also discloses a light-emitting display comprising a plurality of data lines transmitting a data voltage, a plurality of scan lines transmitting select signals including first and second select signals, and a plurality of pixel circuits coupled to the scan lines and the data lines. A pixel circuit includes first through sixth transistors, first and second capacitors, and a light-emitting element. The first transistor includes a first electrode coupled to a data line and a second electrode turned on in response to the second select signal to transmit the data voltage, and the first capacitor is charged with a voltage corresponding to the data voltage. The second and third transistors are serially coupled to each other, coupled in parallel with the first capacitor, and turned on in response to the first select signal. The fourth transistor outputs a current corresponding to the voltage charged in the first capacitor. The fifth and sixth transistors are serially coupled to each other and turned on in response to the first select signal to diode-connect the fourth transistor. The second capacitor is coupled between a first electrode of the first capacitor and a control electrode of the fourth transistor, and it is charged with a voltage corresponding to the threshold voltage of the fourth transistor. The light-emitting element emits light corresponding to the current output from the fourth transistor.

The present invention discloses a light-emitting display comprising a plurality of data lines transmitting a data voltage, a plurality of scan lines transmitting select signals including first and second select signals, and a plurality of pixel circuits coupled to the scan lines and the data lines. A pixel circuit includes first, third, fourth and fifth transistors, a first capacitor, and a light-emitting element. The first transistor includes a first electrode coupled to a data line, and a second electrode is turned on in response to the second select signal to transmit the data voltage. The first capacitor is charged with a voltage corresponding to the data voltage. The third transistor outputs a current corresponding to the voltage charged in the first capacitor. The fourth and fifth transistors are serially coupled to each other and turned on in response to the first select signal to diode-connect the third transistor. The light-emitting element emits light corresponding to the current output from the third transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE EXEMPLARY EMBODIMENTS

Figure 1:
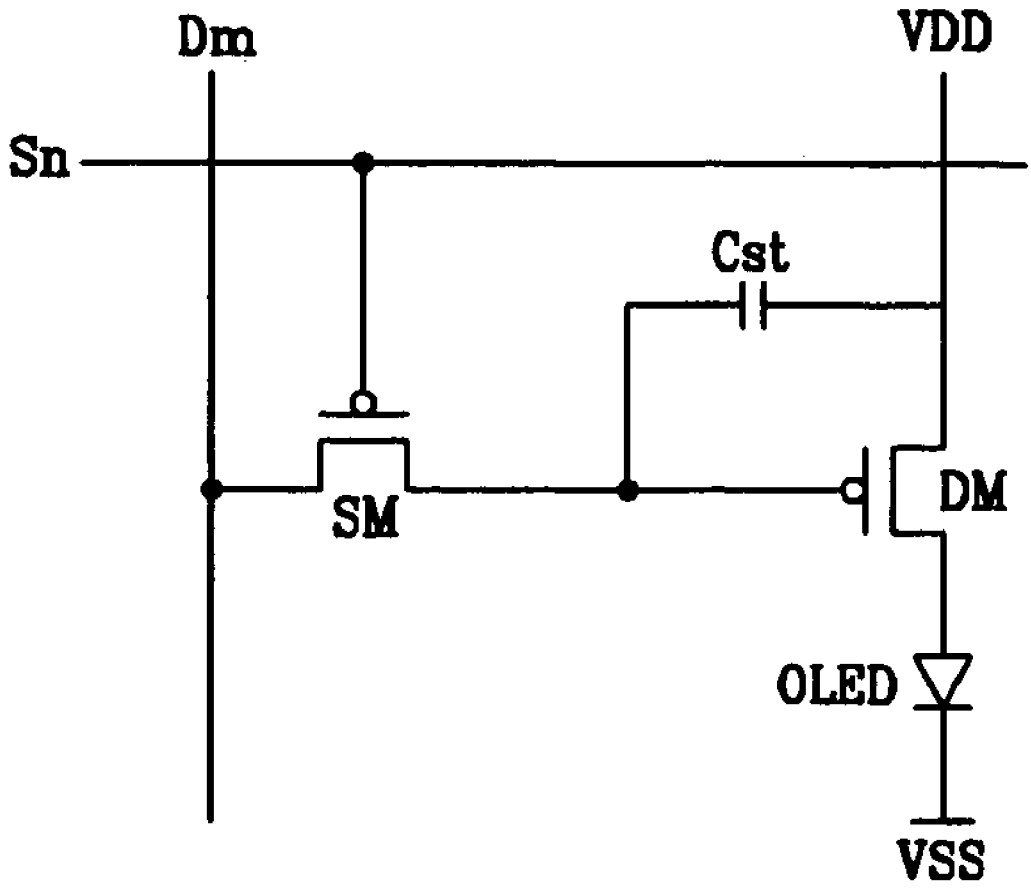
FIG.1 Prior Art
FIG. 1 is an equivalent circuit diagram showing a pixel of a conventional active matrix organic light-emitting display.

The following detailed description shows and describes exemplary embodiments of the present invention, simply by way of illustration of the best mode contemplated by the inventors of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

Figure 2:
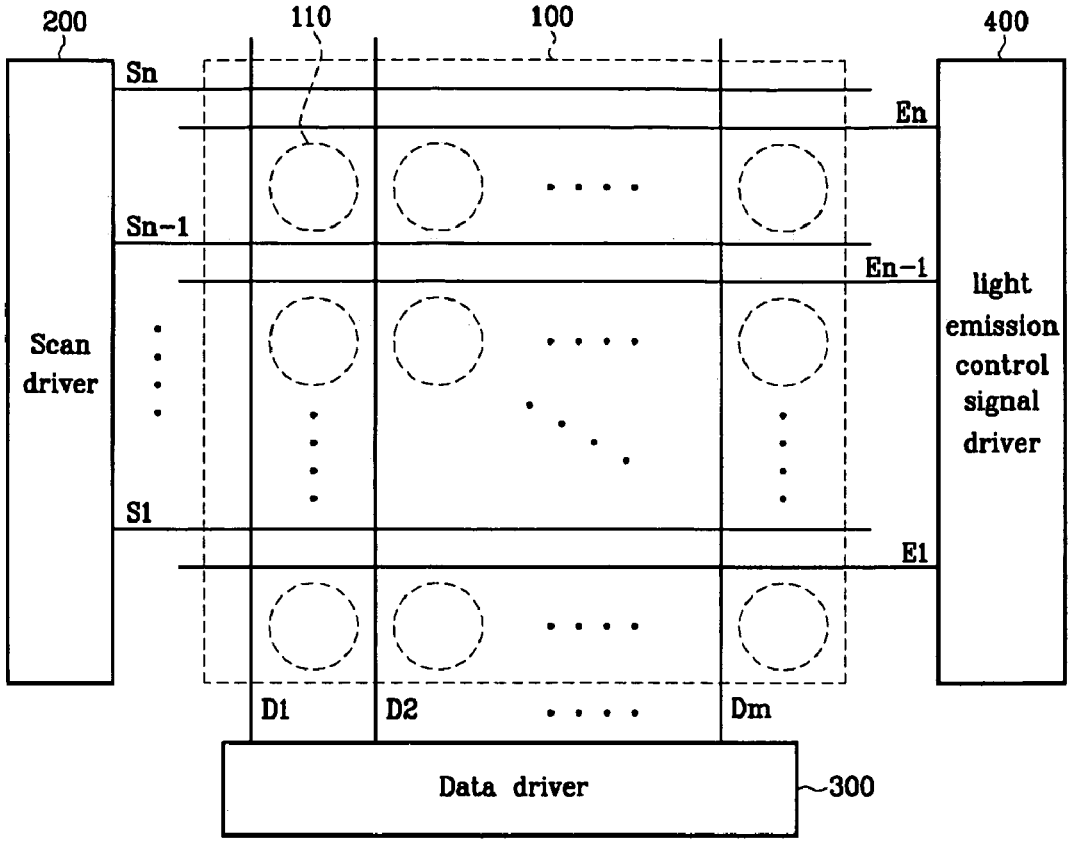
FIG. 2 shows a configuration of an organic light-emitting display according to a first exemplary embodiment of the present invention.

FIG. 2 shows the configuration of an organic light-emitting display according to a first exemplary embodiment of the present invention.

Referring to FIG. 2, the organic light-emitting display may include an organic light-emitting display panel 100, a scan driver 200, a data driver 300, and a light emission control signal driver 400.

The organic light-emitting display panel 100 may include a plurality of data lines $D_1$ to $D_m$ arranged in a column direction, a plurality of scan lines $S_1$ to $S_n$ arranged in a row direction, a plurality of light emission control lines $E_1$ to $E_n$, and a plurality of pixel circuits 110. The data lines $D_1$ to $D_m$ may transmit data signals corresponding to video signals to the pixel circuits 110, and the scan lines $S_1$ to $S_n$ may transmit select signals to the pixel circuits 110.

The scan driver 200 may sequentially generate the select signals and supply them to the scan lines $S_1$ to $S_n$. A scan line transmitting the current select signal may be called a "current scan line," and a scan line transmitting the select signal before the current select signal is transmitted may be called a "previous scan line".

The data driver 300 may generate a data voltage corresponding to a video signal and supply the data voltage to the data lines $D_1$ to $D_m$. The light emission control signal driver 400 may sequentially apply a light emission control signal, for controlling light emission of organic light-emitting elements, to the light emission control lines $E_1$ to $E_n$.

Various methods may be used to couple the scan driver 200, the data driver 300, and/or the light emission control signal driver 400 to the display panel 100. For example, they may be mounted in the form of chip on a tape carrier package coupled to the display panel, they may be mounted in the form of chip on a flexible printed circuit or a film attached to and coupled to the display panel, and they may be directly mounted on the panel's glass substrate. Alternatively, they may be replaced by a driving circuit formed of the same layers as the scan lines, data lines, and thin film transistors on the glass substrate.

Figure 3:
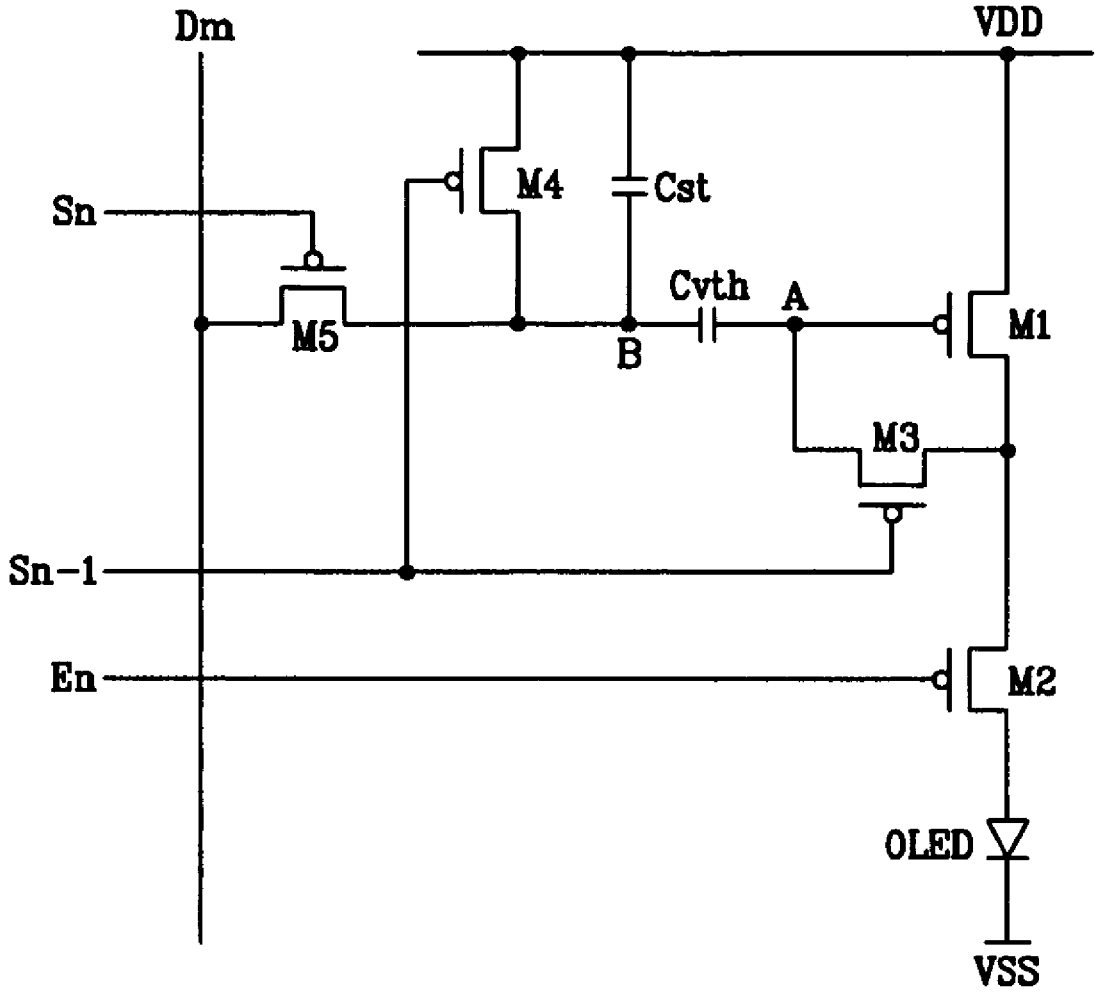
FIG. 3 is an equivalent circuit diagram showing a pixel circuit of the organic light-emitting display of FIG. 2.

FIG. 3 is an equivalent circuit diagram showing a pixel circuit 110 according to the first exemplary embodiment of the present invention. Referring to FIG. 3, the pixel circuit may include five transistors M1, M2, M3, M4 and M5, two capacitors Cst and Cvth, and an organic LED OLED. The five transistors M1 to M5 may be PMOS transistors.

The transistor M1 drives the organic LED OLED, and it may be coupled between a power supply for providing a power supply voltage $V_{DD}$ and the organic LED OLED. The transistor M1 controls the current that flows through the organic LED OLED, via the transistor M2, in response to a voltage applied to the gate of the transistor M1. The transistor M3 may diode-connect the transistor M1 in response to a select signal from the previous scan line Sn-1.

The gate of the transistor M1 may be coupled to node A of the capacitor Cvth. The capacitor Cst and the transistor M4 may be coupled in parallel to each other and between node B of the capacitor Cvth and the power supply providing the voltage $V_{DD}$. The transistor M4 may provide the voltage $V_{DD}$ to node B of the capacitor Cvth in response to the select signal from the previous scan line Sn-1. Alternatively, the transistor M4 may be coupled to a power supply voltage that differs from the power supply voltage $V_{DD}$.

The transistor M5 may deliver a data signal transmitted from the data line Dm to node B of the capacitor Cvth in response to the select signal from the current scan line Sn. The transistor M2 may be coupled between the drain of the transistor M1 and the anode of the organic LED OLED, and it may block the drain of the transistor M1 from the organic LED OLED in response to the select signal from the light emission control line En. The organic LED OLED emits light in response to a current input thereto from the transistor M1 via the transistor M2.

The operation of the pixel circuit 110 will now be explained with reference to FIG. 4, which shows waveforms that may be applied to the pixel circuit 110.

Applying a low level scan voltage to the previous scan line Sn-1, during a period D1, turns on the transistor M3 and diode-connects the transistor M1. Accordingly, the gate-source voltage of the transistor M1 may reach the threshold voltage Vth of the transistor M1. Here, the voltage that may be applied to the gate of the transistor M1, that is, node A of the capacitor Cvth, corresponds to the sum of the power supply voltage $V_{DD}$ and the threshold voltage Vth of the transistor M1 because its source is coupled to the power supply voltage $V_{DD}$. Furthermore, applying the low level scan voltage to the previous scan line Sn-1 turns on the transistor M4, thereby supplying the power supply voltage $V_{DD}$ to node B of the capacitor Cvth. Equation 2 represents the voltage $V_{Cvth}$ that may be charged in the capacitor Cvth.

$$V_{Cvth}=V_{CvthA}-V_{CvthB}=(VDD+Vth)-VDD=Vth \quad \text{[Equation 2]}$$

Here, $V_{CvthA}$ and $V_{CvthB}$ are the voltages applied to nodes A and B of the capacitor Cvth, respectively.

During the period D1, a high level signal may be applied to the light emission control line En, thus turning off the transistor M2. This prevents the current flowing through the transistor M1 from flowing to the organic LED OLED. Furthermore, a high level signal may be applied to the current scan line Sn to turn off the transistor M5.

Applying a low level scan voltage to the current scan line Sn, during the following period D2, turns on the transistor M5, thereby supplying a data voltage Vdata to node B of the capacitor Cvth. Additionally, the gate of the transistor M1 may be provided with a voltage corresponding to the sum of the data voltage Vdata and its threshold voltage Vth because the capacitor Cvth is charged with a voltage corresponding to the threshold voltage Vth of the transistor M1. That is, Equation 3 represents the gate-source voltage Vgs of the transistor M1. Here, the light emission control line En may be provided with a high level signal, which keeps the transistor M2 turned off.

$$Vgs=(V\text{data}+Vth)-VDD \quad \text{[Equation 3]}$$

During a period D3, the transistor M2 may be turned on in response to a low-level light emission control signal of the light emission control line En, thereby providing the current $I_{OLED}$, corresponding to the gate-source voltage Vgs of the transistor M1, to the organic LED OLED to emit light. Equation 4 represents the current $I_{OLED}$.

$$\begin{aligned} I_{OLED} &= \frac{\beta}{2}(Vgs - Vth)^2 \quad \text{[Equation 4]} \\ &= \frac{\beta}{2}((Vdata + Vth - VDD) - Vth)^2 \\ &= \frac{\beta}{2}(VDD - Vdata)^2 \end{aligned}$$

Here, $I_{OLED}$ is the current flowing in the organic LED OLED, Vgs is the gate-source voltage of the transistor M1, and Vth is the threshold voltage of the transistor M1. Additionally, Vdata is the data voltage and β is a constant. Equation 4 shows that the display panel may be stably driven because the current $I_{OLED}$ is determined by the data voltage Vdata and the power supply voltage $V_{DD}$, irrespective of the threshold voltage Vth of the driving transistor M1.

Figure 4:
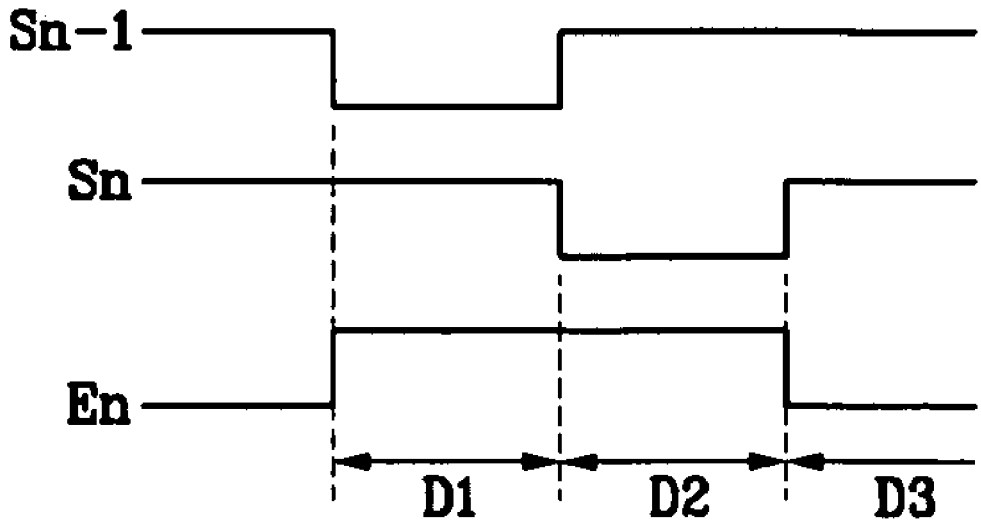
FIG. 4 shows waveforms that may be applied to pixel circuits of exemplary embodiments of the present invention.

The signal waveforms shown in FIG. 4 are exemplary, and they may be modified. For example, the starting point of the high level signal applied to the light emission control line En may lag behind the starting point of the low level select signal applied to the previous scan line Sn-1. Furthermore, the end point of the high level signal applied to the light emission control line En may lag behind the end point of the low level select signal applied to the current scan line Sn.

As described above, applying the low level select signal to the previous scan line Sn-1 turns off the transistors M3 and M4, and applying the low level select signal to the current scan line Sn turns on the transistor M5, thereby providing node B of the capacitor Cst with the data voltage. Accordingly, the voltage corresponding to the data voltage may be charged in the capacitor Cst while the driving transistor M1 is turned on. According to the voltage charged in the capacitor Cst, the gate-source voltage Vgs of the driving transistor M1 may be continuously maintained, even when the switching transistor M5 is turned off and the data voltage is not supplied to node B.

However, parasitic capacitance existing in node B may generate a voltage variation ΔV in the voltage supplied to node B, which may result in a voltage shift in node B. This voltage shift is called kickback, and the voltage variation ΔV is called kickback voltage. The kickback may generate a sticking image when displaying images and degrade the display panel's display characteristics. When the kickback voltage is greater than a gray-scale level interval, the display quality of the display panel may significantly deteriorate, such that images with the same gray scales may be displayed differently.

Exemplary embodiments of the present invention for solving the effect of the kickback will now be explained in detail.

Figure 5:
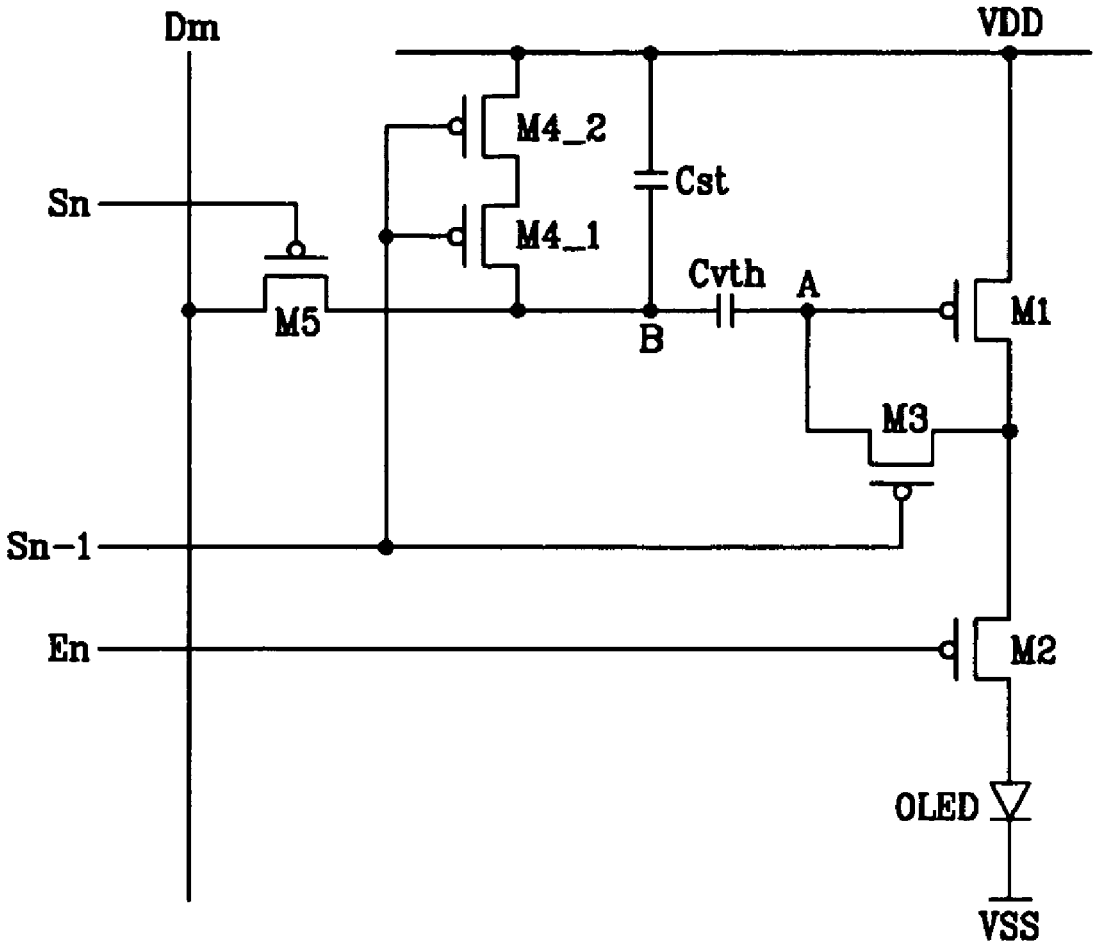
FIG. 5 is an equivalent circuit diagram showing a pixel circuit according to a second exemplary embodiment of the present invention.

FIG. 5 is an equivalent circuit diagram showing a pixel circuit according to a second exemplary embodiment of the present invention. This pixel circuit differs from the pixel circuit of the first exemplary embodiment in that dual transistors M4_1 and M4_2 are employed to reduce the kickback voltage at node B.

Referring to FIG. 5, the pixel circuit may include six transistors M1, M2, M3, M4_1, M4_2, and M5, two capacitors Cst and Cvth, and an organic LED OLED. The four transistors M1, M2, M3, and M5, the two capacitors Cst and Cvth, and the organic LED OLED may be identically configured and operated as in the first exemplary embodiment. Hence, detailed explanations thereof are omitted.

The source of the transistor M4_2 may be coupled to the power supply voltage $V_{DD}$, and its drain may be coupled to the source of the transistor M4_1. The drain of the transistor M4_1 may be coupled to the drain of the transistor M5. That is, the two transistors M4_1 and M4_2 may form dual transistors that are serially coupled to each other. The gates of the transistors M4_1 and M4_2 may be coupled to the previous scan line Sn-1. Accordingly, the two transistors M4_1 and M4_2 may be simultaneously turned on in response to a previous select signal to supply the power supply voltage $V_{DD}$ to an end of the capacitor Cst.

Turning the transistors M4_1 and M4_2 off and turning the transistor M5 may reduce the kickback voltage at node B. Accordingly, a variation in the data voltage applied to node B and a voltage variation in the gate node A of the transistor M1 may decrease. Consequently, a variation in the gate-source voltage Vgs of the transistor M1, caused by the kickback voltage, may decrease, thereby reducing the influence of kickback on the current transmitted to the organic LED OLED.

When the total channel length of the dual transistors M4_1 and M4_2 is kept constant, the kickback voltage may be more effectively reduced when the channel of the transistor M4_2 is longer than the channel of the transistor M4_1.

Table 1 shows voltages of node B with the dual transistors M4_1 and M4_2 turned on and turned off, in the case where they each have a channel width W of 5 μm, and the channel length L of the transistor M4_1 plus the channel length L of transistor M4_2 is 20 μm.

TABLE 1

| Transistor size | | Node B voltage | | Kickback |
|---|---|---|---|---|
| M4_1(W/L) | M4_2(W/L) | When turned on | When turned off | voltage |
| 5/15 μm | 5/5 μm | 5.0 V | 5.4917 V | 0.4917 V |
| 5/10 μm | 5/10 μm | 5.0 V | 5.3811 V | 0.3811 V |
| 5/7 μm | 5/13 μm | 5.0 V | 5.3217 V | 0.3217 V |
| 5/5 μm | 5/15 μm | 5.0 V | 5.2834 V | 0.2834 V |

Table 1 shows that as the channel length L of the transistor M4_2 increases, the kickback voltage at node B decreases. That is, when the channel of the transistor M4_2 is longer than the channel of the transistor M4_1, the current $I_{OLED}$ corresponding to the data voltage may be more stably supplied to the organic LED OLED, thereby improving the display panel's display characteristics.

While Table 1 shows the minimum channel length of the transistor M4_1 as 5 μm, it may be less than 5 μm if the transistor's characteristics are secured when it is fabricated with a channel length shorter than 5 μm. As the channel length L of the transistor M4_1 shortens, parasitic capacitance decreases, and the influence of kickback may decrease.

While the pixel circuit shown in FIG. 5 employs the serially coupled dual transistors M4_1 and M4_2, the pixel circuit may alternatively use a dual-gate transistor. While the dual transistors indicate that two transistors formed one source region, one drain region and one gate electrode are coupled to each other, the dual gate transistor indicates that one transistor has one source region, one drain region and two gate electrodes connected each other.

A third exemplary embodiment of the present invention will now be explained.

Figure 6:
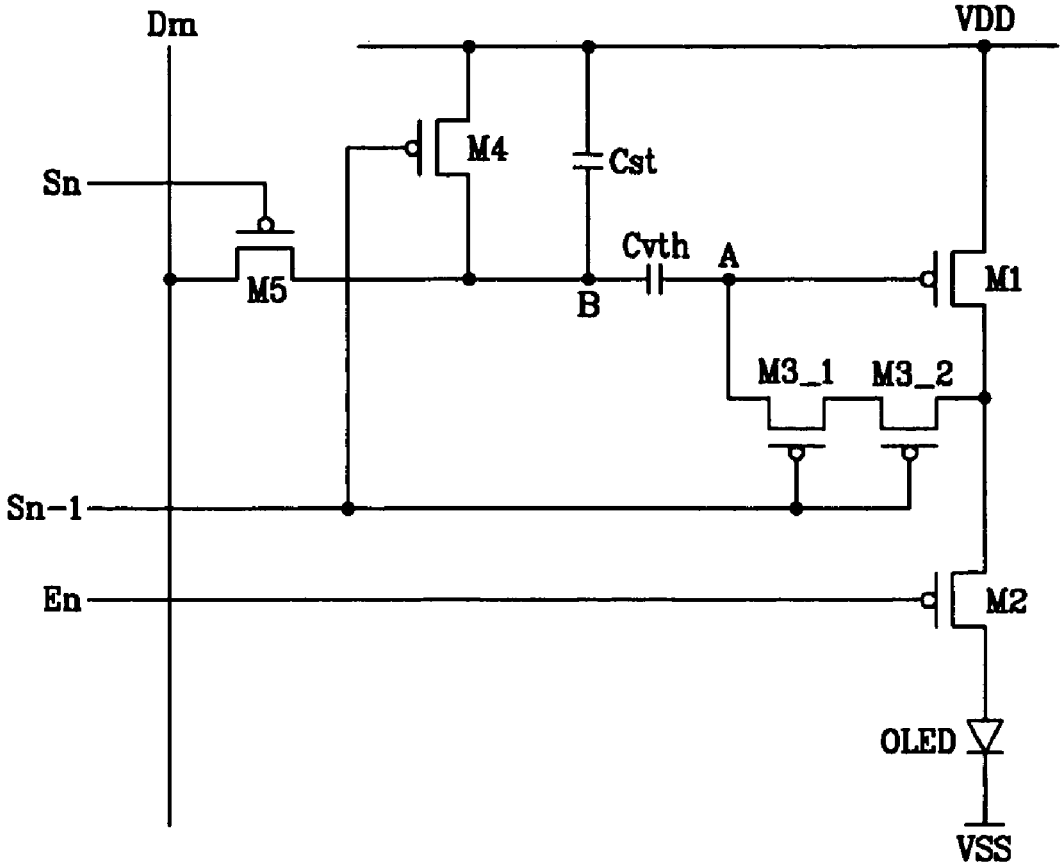
FIG. 6 is an equivalent circuit diagram showing a pixel circuit according to a third exemplary embodiment of the present invention.

FIG. 6 is an equivalent circuit diagram showing a pixel circuit according to the third exemplary embodiment of the present invention. The pixel circuit differs from the pixel circuit of the first exemplary embodiment in that dual transistors M3_1 and M3_2 are employed to reduce the kickback voltage caused by parasitic capacitance existing between the gate and source of the transistor M1.

Referring to FIG. 6, the pixel circuit may include six transistors M1, M2, M3_1, M3_2, M4, and M5, two capacitors Cst and Cvth, and an organic LED OLED. The four transistors M1, M2, M4, and M5, the two capacitors Cst and Cvth, and the organic LED OLED may be identically configured and operated as in the first exemplary embodiment. Hence, detailed explanations thereof are omitted.

The source of the transistor M3_2 may be coupled to the drain of the transistor M1, and its drain may be coupled to the source of the transistor M3_1. The drain of the transistor M3_1 may be coupled to the gate of the transistor M1. That is, the two transistors M3_1 and M3_2 form dual transistors that are serially coupled to each other. The gates of the transistors M3_1 and M3_2 may be coupled to the previous scan line Sn-1. Accordingly, the two transistors M3_1 and M3_2 may be simultaneously turned on in response to the previous select signal to diode-connect the transistor M1.

Turning off the transistors M3_1 and M3_2 and turning on the transistor M5 may reduce the kickback voltage at node A. Accordingly, the influence of voltage variation due to the kickback voltage at gate node A of the transistor M1 may be decreased, thereby decreasing a variation in the gate-source voltage Vgs of the transistor M1 caused by the kickback voltage. Consequently, the influence of kickback on the current $I_{OLED}$ transmitted to the organic LED OLED may be reduced.

When the total channel length of the dual transistors M3_1 and M3_2 is kept constant, the kickback voltage may be more effectively reduced when the channel of the transistor M3_2 is longer than the channel of the transistor M3_1.

Table 2 shows voltages of node A (i.e. the gate of the transistor M1), with the dual transistors M3_1 and M3_2 turned on and turned off, in the case where they each have a channel width W of 5 μm, and the channel length L of the transistor M3_1 plus the channel length L of the transistor M3_2 is 20 μm.

TABLE 2

| Transistor size | | Gate voltage of transistor M1 | | Kickback |
|---|---|---|---|---|
| M3_1(W/L) | M3_2(W/L) | When turned on | When turned off | voltage |
| 5/15 μm | 5/5 μm | 3.6570 V | 4.6653 V | 1.0083 V |
| 5/10 μm | 5/10 μm | 3.2503 V | 4.1223 V | 0.8720 V |
| 5/7 μm | 5/13 μm | 3.1370 V | 3.9445 V | 0.8075 V |
| 5/5 μm | 5/15 μm | 3.0791 V | 3.8463 V | 0.7672 V |

Table 2 shows that as the channel length L of the transistor M3_2 increases, the kickback voltage at the gate of the transistor M1 decreases. That is, when the channel of the transistor M3_2 is longer than the channel of the transistor M3_1, the current $I_{OLED}$ corresponding to the data voltage may be more stably supplied to the organic LED OLED, thereby improving the display panel's display characteristics.

While FIG. 6 shows the pixel circuit with the serially coupled dual transistors M3_1 and M3_2, the pixel circuit may alternative use a dual-gate transistor. While Table 2 shows the minimum channel length of the transistor M3_1 as 5 μm, it may be reduced to less than 5 μm if the transistor's characteristics are secured even when it is fabricated with a channel length shorter than 5 μm. As the channel length of the transistor M3_1 shortens, parasitic capacitance may decrease, and the influence of kickback may decrease.

A fourth exemplary embodiment of the present invention will now be explained.

Figure 7:
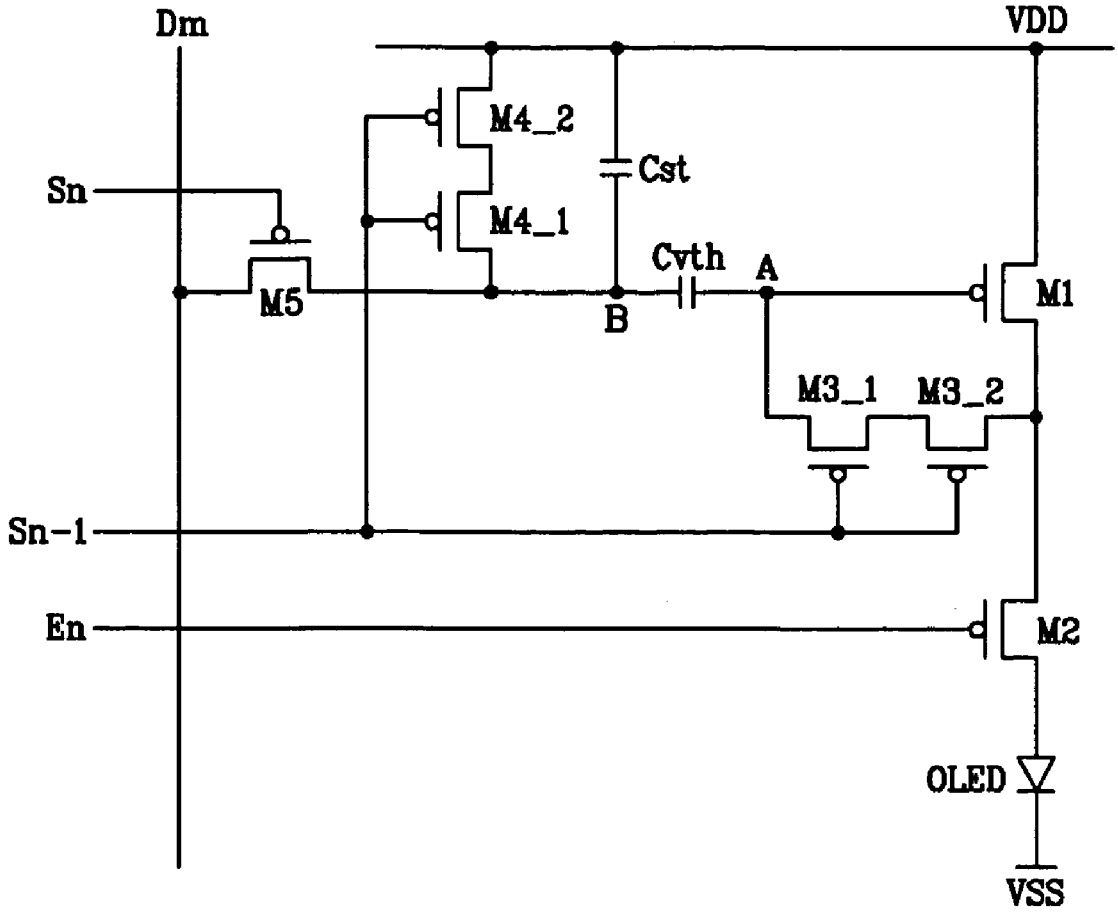
FIG. 7 is an equivalent circuit diagram showing a pixel circuit according to a fourth exemplary embodiment of the present invention.

FIG. 7 is an equivalent circuit diagram showing a pixel circuit according to the fourth exemplary embodiment of the present invention. The pixel circuit differs from the pixel circuits of the second and third exemplary embodiments in that dual transistors M4_1 and M4_2 may be employed to reduce the kickback voltage at node B, and dual transistors M3_1 and M3_2 may be used to reduce the kickback voltage caused by parasitic capacitance existing between the gate and source of the transistor M1.

Referring to FIG. 7, the pixel circuit may include seven transistors M1, M2, M3_1, M3_2, M4_1, M4_2, and M5, two capacitors Cst and Cvth, and an organic LED OLED. The three transistors M1, M2, and M5, the two capacitors Cst and Cvth, and the organic LED OLED may be identically configured and operated as in the first exemplary embodiment, of FIG. 3, the transistors M4_1 and M4_2 may be identical to those of the pixel circuit of the second exemplary embodiment, of FIG. 5, and the configuration and operation of the transistors M3_1 and M3_2 may be identical to those of the pixel circuit of the third exemplary embodiment of FIG. 6. Thus, detailed explanations thereof are omitted.

As shown in FIG. 7, using the transistors M3_1, M3_2 and the transistors M4_1, M4_2 may simultaneously reduce the kickback voltage at node B and the kickback voltage caused by the parasitic capacitance between the gate and source of the transistor M1.

As described above, exemplary embodiments of the present invention use dual transistors to reduce the kickback voltage caused by a parasitic capacitance component existing in the pixel circuit. Particularly, dual transistors having different channel lengths may be coupled in parallel with the capacitor charged with a voltage corresponding to a data voltage to reduce the influence of kickback on an electrode of the capacitor. Furthermore, the kickback voltage caused by parasitic capacitance existing between the gate and source/drain of the transistor driving the organic LED may be reduced using dual transistors having different sizes. This may effectively decrease the influence of kickback on the gate of the driving transistor. Consequently, the influence of kickback may be reduced, thereby improving the display characteristics of the light-emitting display.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light-emitting display, comprising:

a plurality of data lines transmitting a data voltage;

a plurality of scan lines transmitting a select signal; and a plurality of pixel circuits coupled to the scan lines and the data lines, wherein a pixel circuit comprises:

a first transistor and a second transistor serially coupled to each other and turned on in response to a first control signal;

a first capacitor coupled in parallel with the first transistor and the second transistor;

a third transistor supplying the data voltage to a first electrode of the first capacitor in response to the select signal;

a fourth transistor outputting a current corresponding to a gate-source voltage of the fourth transistor, the gate-source voltage being based on a voltage of the first capacitor; and a light-emitting element emitting light in response to the current from the fourth transistor.

2. The light-emitting display of claim 1, wherein a first electrode of the first transistor is coupled to the first electrode of the first capacitor;

wherein a second electrode of the first transistor is coupled to a first electrode of the second transistor; and wherein a second electrode of the second transistor is coupled to a second electrode of the first capacitor.

3. The light-emitting display of claim 2, wherein the first transistor and the second transistor are a dual-gate transistor.

4. The light-emitting display of claim 2, wherein the first transistor and the second transistor have different sizes.

5. The light-emitting display of claim 4, wherein a channel of the second transistor is longer than a channel of the first transistor.

6. The light-emitting display of claim 1, wherein the pixel circuit further comprises:

a second capacitor coupled between the first electrode of the first capacitor and a gate of the fourth transistor; and a first switch diode-connecting the fourth transistor in response to the first control signal, wherein the gate of the fourth transistor is coupled to a second electrode of the second capacitor, and wherein a source of the fourth transistor is coupled to a second electrode of the first capacitor.

7. The light-emitting display of claim 6, wherein the first switch includes a fifth transistor and a sixth transistor serially coupled to each other and turned on in response to the first control signal.

8. The light-emitting display of claim 7, wherein the fifth transistor and the sixth transistor are a dual-gate transistor.

9. The light-emitting display of claim 8, wherein the pixel circuit further comprises:

a second switch transmitting the current output from the fourth transistor to the light-emitting element in response to a second control signal, wherein the second control signal is supplied to the pixel circuit after the first control signal and the select signal.

10. The light-emitting display of claim 1, wherein the first control signal is a previous select signal that is applied to the pixel circuit before the select signal.

11. The light-emitting display of claim 1, wherein the light-emitting element uses an organic material to emit light.

* * * * *